US005403114A

United States Patent [19]

James

[11] Patent Number: 5,403,114

[45] Date of Patent: Apr. 4, 1995

[54] BARRIER MODULE LIFTING CLAMP

[76] Inventor: Danny L. James, 6456 Cotswold Way, Broad Run, Va. 22014

[21] Appl. No.: 258,056

[22] Filed: Jun. 10, 1994

[51] Int. Cl.[6] ..... E01F 13/00

[52] U.S. Cl. ..... 404/6; 294/90

[58] Field of Search ..... 404/6, 9, 12; 256/13.1; 414/460; 294/81.51, 90, 111

[56] References Cited

U.S. PATENT DOCUMENTS

| | | | |
|---|---|---|---|
| 2,920,917 | 1/1960 | Sheehan | 294/81.51 |
| 3,044,819 | 7/1962 | Pielle | 294/81.51 X |
| 3,210,113 | 10/1965 | Tantlinger | 294/81.51 |
| 4,093,296 | 6/1978 | Itoh | 294/90 |
| 4,500,225 | 2/1985 | Quittner | 404/6 |
| 4,806,044 | 2/1989 | Ducketz | 404/6 |
| 5,088,874 | 2/1992 | Quittner | 404/6 X |
| 5,171,053 | 12/1992 | Rouleau | 294/90 X |
| 5,246,305 | 9/1993 | Peek | 404/6 |
| 5,252,951 | 10/1993 | Peek | 404/6 |

*Primary Examiner*—William P. Neuder
*Attorney, Agent, or Firm*—Roland H. Shubert

[57] ABSTRACT

Concrete barrier modules of the type having a T-shaped upper section are loaded and positioned without damage through use of a clamp device having a pair of jaw members hinged from a horizontal plate. Each jaw member has an inwardly directed lifting surface arranged to press upon an under surface of the module upper section. A hoist bar interacts with a latch to secure the jaw members either in an open or a closed position so long as a lifting force is applied to the hoist bar.

15 Claims, 3 Drawing Sheets

BARRIER MODULE LIFTING CLAMP

TECHNICAL FIELD

This invention relates to means for lifting and moving barrier modules of the kind used to separate traffic lanes on a roadway.

More particularly, this invention relates to a lifting device for the loading and unloading of barrier modules from trucks or other transport means and for placement of the barriers in line for interconnection.

BACKGROUND ART

It is common practice during highway construction or repair to use concrete barriers as temporary walls between adjacent traffic lanes or to separate traffic lanes from construction zones. Such lane barriers have traditionally taken the form of individual, steel-reinforced concrete modules arranged in an end to end fashion. Individual barrier modules were transported to the site by truck and placed into position using cranes or other lifting devices. Shifting such a barrier from one lane to another requires picking up, moving and replacing each individual module. That procedure disrupts traffic, is time consuming, labor intensive and expensive.

Systems have recently been developed that enable a lane barrier to be rapidly shifted, either laterally or longitudinally, along a roadway so as to change the traffic pattern at will. Those systems typically comprise a series of concrete barrier modules linked together end to end through pivoted fastenings. The barrier modules, in cross-section, are provided with a relatively massive base, an upwardly extending, wall-like midsection and a T-shaped top section. A mobile transport vehicle is used to move the lane barrier or to transfer it from one lane side to the other. The transport vehicle includes a conveyor having a series of rollers that engage each barrier module at the underside of its T-shaped top section to lift, support and transfer the module from one place to another.

One such prior art system for moving a lane barrier is described in a patent to Quittner, U.S. Pat. No. 5,088,874. That system includes a series of wheeled barrier module transporting units arranged to straddle a length of highway barriers, to lift the barriers, and to move the length as a train. Another patent to the same inventor, U.S. Pat. No. 4,500,225, discloses barrier modules of a particular configuration including a T-shaped upper end connected to form a highway barrier. The patent also describes a barrier transfer device adapted to shift the barrier from one lane to a next adjacent lane. That transfer device employs a conveyor having rollers which engage the underside of the T-shaped upper module end to lift the modules, move them laterally and deposit them in a new position.

Other patents illustrating the use of barrier modules having a T-shaped upper section and systems for moving lengths of such interconnected modules include two patents to Peek, U.S. Pat. Nos. 5,246,305 and 5,253,951 and a patent to Duckett, U.S. Pat. No. 4,806,044. All of those prior art systems use wheels or rollers that pick up the barrier modules by engaging the underside of the outwardly extended top module flange. While those systems generally work well, all require that the underside of the top flange or T-section of the modules be in good condition without large chips, breaks or gouges.

Such imperfections interfere with the rollers and even stall operation of the transfer conveyor.

In the original placement of barrier modules to form a moveable highway barrier, it is common practice to transport the modules to a site by truck. A fork lift is then used to load and unload modules from the truck and to place the modules in position for interconnection to form a continuous barrier train. Individual barrier modules are typically about 1 meter in length and are ordinarily arranged for truck transport in groups of two set end to end and placed laterally across the truck bed. That arrangement allows ready access to a fork lift. The fork lift tines are set apart a distance just greater than the thickness of the middle wall or web of the modules so that the top surface of the tines engages the underside of the top module flange.

Handling the modules in this way frequently results in damage being inflicted to the critical underside of the top flange by the fork lift tines. Those damaged modules ordinarily cannot be repaired but must be discarded. In light of this background, it can readily be appreciated that a system that avoids damage to barrier modules during their loading and unloading offers considerable advantage and economy.

DISCLOSURE OF THE INVENTION

This invention provides a lifting device for use with barrier modules of the type having a T-shaped upper section to load, unload and position modules for interconnection to form a highway barrier of extended length. The lifting device includes a pair of jaw members each hinged to a top member and having a flange arranged to engage the underside of the T-shaped upper section flange. A hoist bar is arranged with the top member and jaws to lock the jaws in place for lifting a module and to release the jaws after placement of the module.

Thus, it is an object of this invention to provide improved means for handling barrier modules.

Another object of this invention is to reduce the amount and severity of damage done to barrier modules as they are loaded and unloaded and placed in position to form a highway barrier.

Other objects will be apparent from the following description of exemplary embodiments and techniques.

DESCRIPTION OF THE DRAWING

Specific embodiments of the invention are illustrated in the drawing which.

DETAILED DESCRIPTION OF PREFERRED EMBODIMENTS

Figure 1:
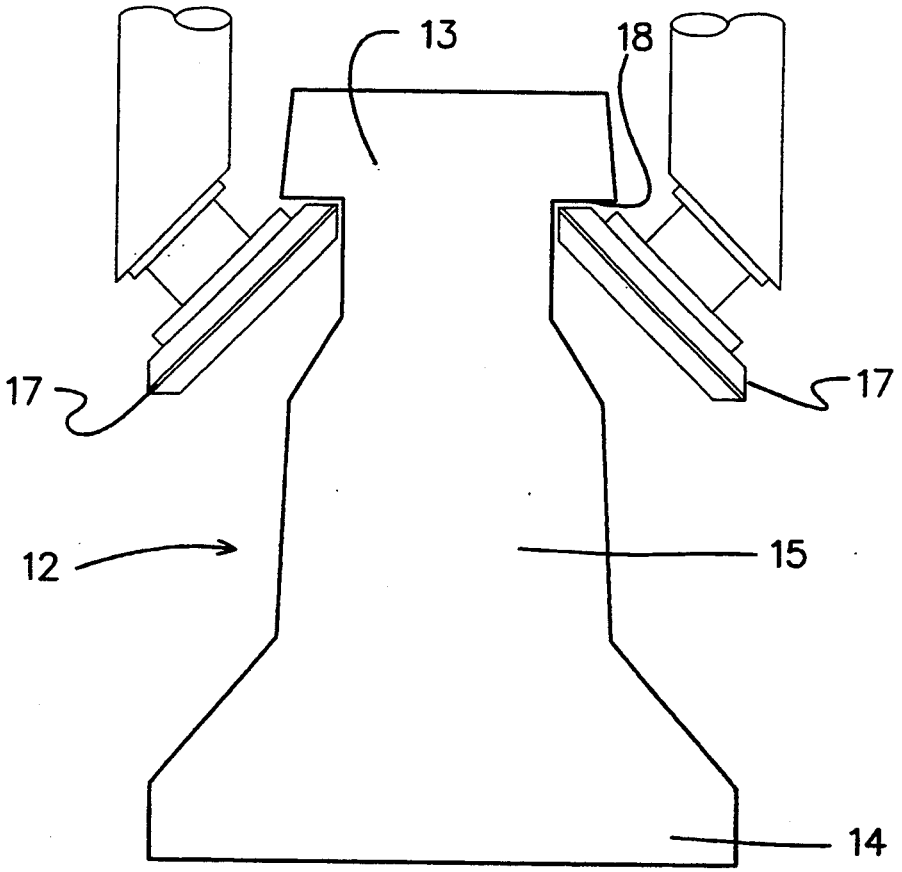
FIG. 1 is an end view of a concrete barrier of the kind to which this invention is directed showing the lane transfer rollers of the prior art.

Certain preferred embodiments of this invention will be described and discussed in detail with reference to the drawing figures in which like reference numerals refer to the same component or part illustrated in the different figures.

Referring first to FIG. 1, there is shown an end view of a concrete barrier module 12, of the kind to which this invention is directed, illustrating how the lane transfer, conveyor rollers of the prior art interact with the module. Module 12, in cross-section, includes a T-shaped upper section 13, a base 14, and a mid-section 15. In dimension, typical modules in commercial use have a top width of about 1 foot, a base width of about 2 feet, a length of about 3 feet, and a height of some 2½ to 3 feet. Conveyor rollers 17 bear upon the under face 18 of T-shaped section 13 to lift barrier modules and to shift them laterally from one side of a lane to another. As may be appreciated, the presence of large chips, breaks or gouges on the under face 18 of a barrier module will interfere with rollers 17 and will disrupt operation of a barrier-shifting conveyor.

Figure 2:
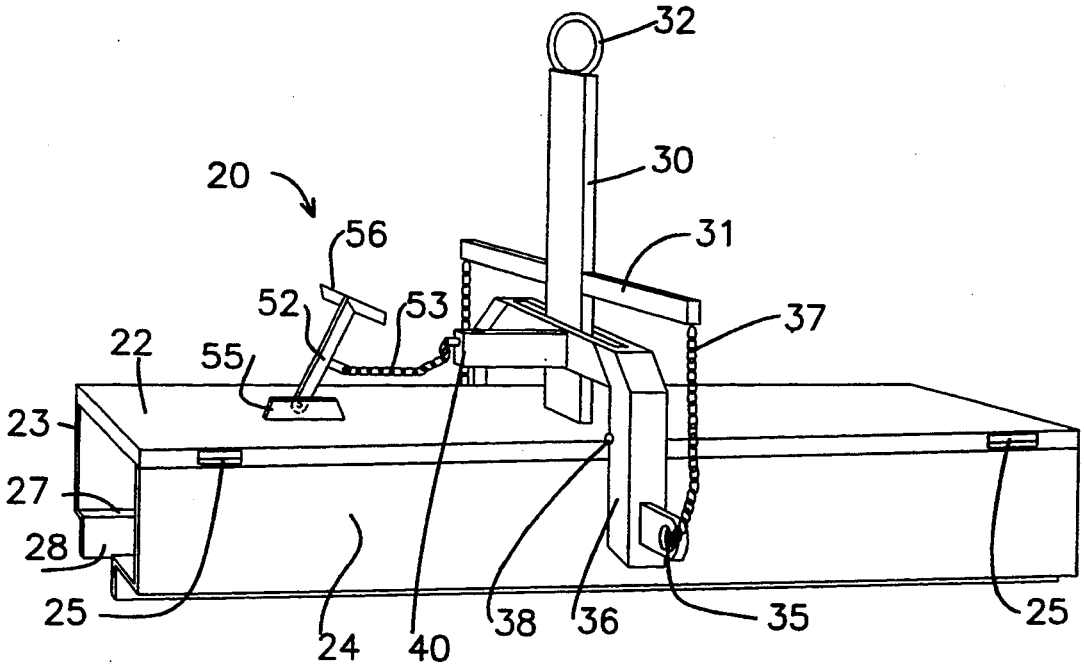
FIG. 2 is a perspective view of the barrier module lifting device of this invention.

Referring now to FIG. 2, there is shown a perspective view of the lifting clamp 20 of this invention. Clamp 20 comprises a top plate 22 of elongated, rectangular shape having a width slightly greater than the width of upper section 13 of the modules to be lifted. In a preferred embodiment, clamp 20 is sized to lift two modules at a time, so the length of plate 22 is conveniently set at essentially twice the length of a module. Hinged along the sides of plate 22 are a pair of jaw members 23. The two jaw members are arranged in mirror image relationship, one to the other, with the top of face 24 of each jaw member attached to the side of plate 22 through a plurality of hinges 25. Thus, each jaw member is free to rotate about the axis of hinges 25 from the vertical outwardly through a small arc, conveniently about 30° to 45°. It is preferred, but not required, that the length of the jaw members be essentially equal to that of the top plate 22, while the height of each jaw face 24 must be somewhat greater than is the vertical thickness of the module T-section 13. The bottom edge of each jaw face 24 is bent inwardly at right angles to the jaw face to form an essentially horizontal lifting surface 27 that is arranged to contact underface 18 of a barrier module. The inward side of each lifting surface 27 may be turned downwardly to form a jaw lip 28 that is generally parallel to jaw face 24. That arrangement adds stiffness and strength to the lifting surfaces 27.

It is necessary that top plate 22 and jaw members 23 be made sufficiently strong to lift and support a pair of barrier modules without any significant degree of bending or distortion. A single barrier module typically weighs about 1,500 lb, so the clamp must support loads of 3,000 lb or more. Therefore, it is preferred that top plate 22 and jaw members 23 be constructed of steel plate or other high strength material.

A hoist bar 30, having a crossarm 31 fixed thereto, is situated to move freely, up and down, through an opening at the center of top plate 22. A hook or eye 32 is provided at the top of hoist bar 30 for convenient attachment to the lifting forks of a forklift, or to a crane, hoist or other lifting device. Crossarm 31 is arranged perpendicularly to hoist bar 30 and to the long axis of top plate 22. The ends of crossarm 31 extend beyond the sides of plate 22 and connect to ear 35 of pivot arm 36 through a flexible connection means that may be a chain or cable 37. Pivot arm 36 comprises a structural member that is fixedly attached, by welding for example, to jaw face 24. It pivots about hinge point 38 at the boundary between the top plate 22 and jaw face 24.

Figure 3:
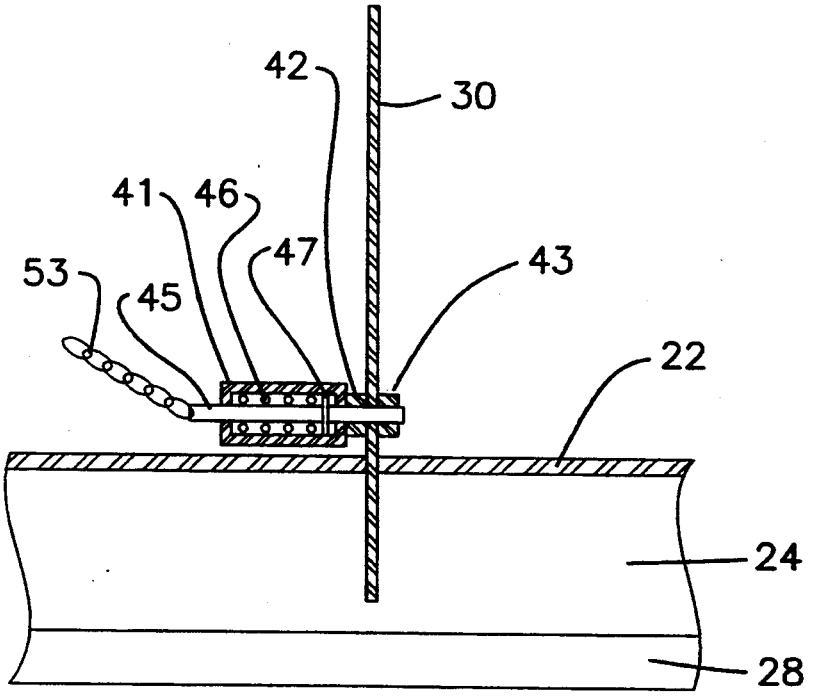
FIG. 3 is a detail view in partial section of the hoist bar and jaw latching means.

The vertical movement of hoist bar 30 is limited by action of latching means 40, shown in more detail in FIG. 3. Referring now to both FIGS. 2 and 3, latching means 40 includes an outer housing 41 terminating in an interconnected front plate 42 and rear plate 43 that form a vertical channel through which hoist bar 30 passes. Latching means 40 confines a pin 45 that is urged rearwardly by action of spring 46 pressing upon washer 47. A hole 49 (see FIG. 4), aligned with pin 45, is provided in both front plate 42 and rear plate 43. Likewise, a matching hole 50 (FIG. 5) is provided in hoist bar 30. Pin 45 is free to pass through holes 49 in the plates and hole 50 in the hoist bar when the three are aligned, thus locking bar 30 to latching means 40. The forward end of pin 45 is attached to a lever 52 through connector 53 that may be a chain or cable. Lever 52 is pivotally attached to the top of plate 22 at its lower end through tabs 55. A handle 56 may be provided at the top of the lever for ease in operation.

Figure 4:
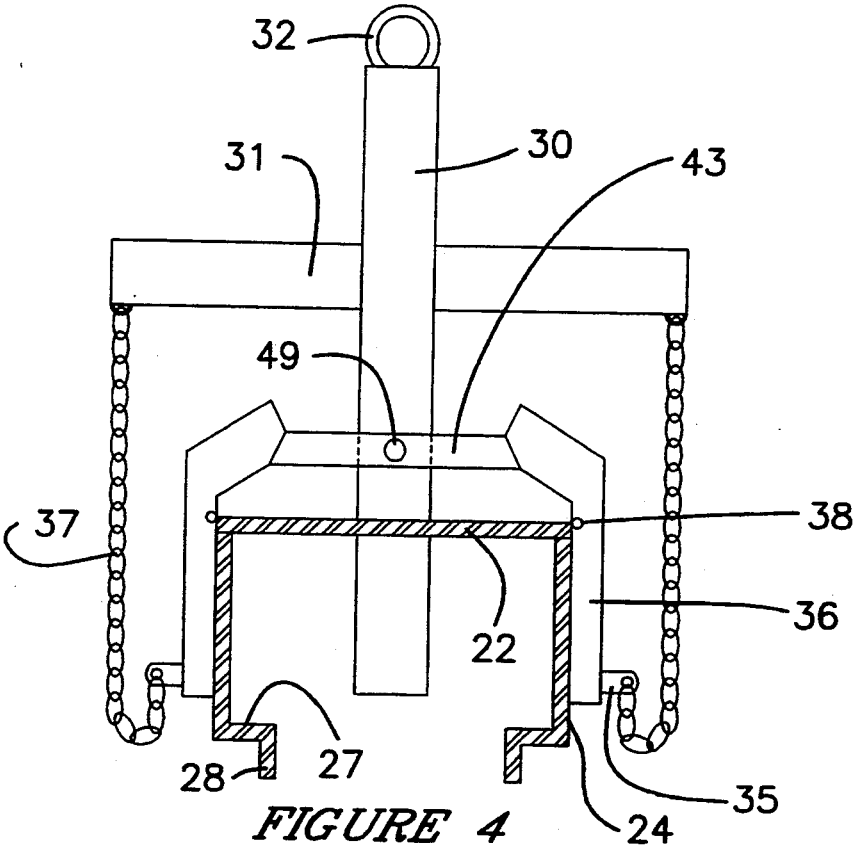
FIG. 4 is an end view of the FIG. 2 device showing it in a closed position.
Figure 5:
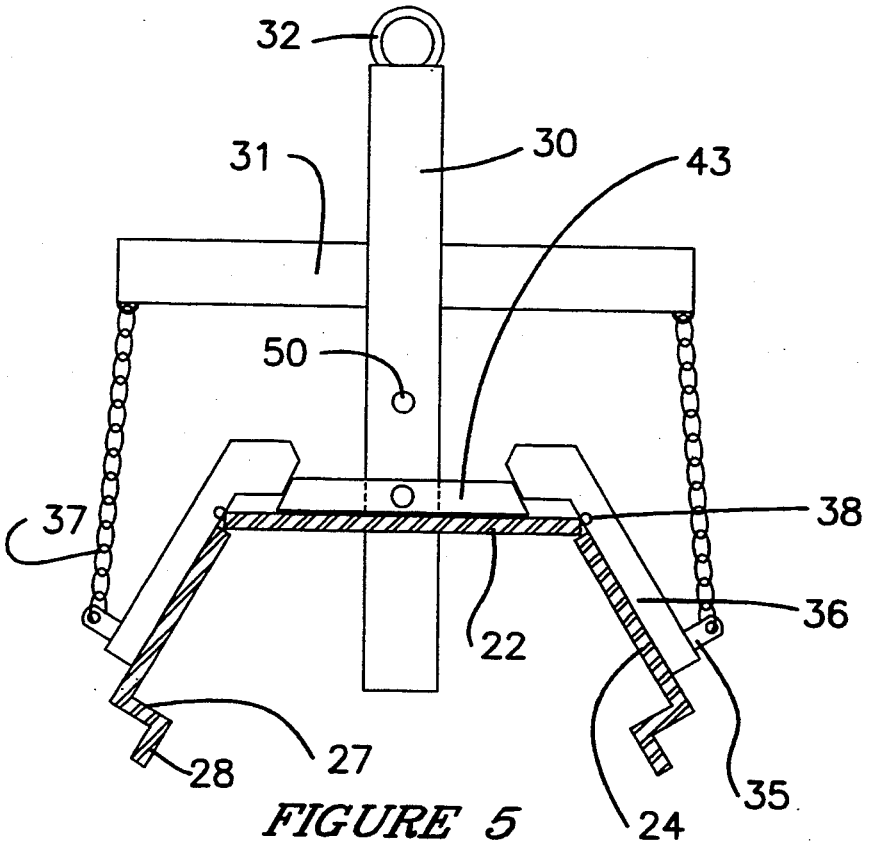
FIG. 5 is an end view of the FIG. 2 device showing it in an open position.

The manner in which the clamp of this invention operates is best shown by reference to FIGS. 4 and 5. FIG. 4 is an end view of the clamp showing it closed as it would be when picking up a module, while FIG. 5 shows the clamp in an open position. When the clamp is in the closed position, pin 45 locks the hoist bar 30 to the latching means 40. A lifting force that is applied to bar 30 is thereby transferred to latching means 40. The ends 57 of rear latch plate 43 are cut at an acute angle as shown, suitably about 45°, so that the bottom side 58 of plate 43 is longer than is its top side 59. Inner ends 61 of pivot arms 36 are likewise formed at an angle that matches the angle of plate ends 57 when the clamp is in a closed position. In this mode, a lifting force applied to bar 30 is transferred to pivot arms 36 through plate ends 57 and pivot arm inner ends 61. Pivot arms 36 are, in turn, fixed to jaw faces 24 that are pressed inwardly so long as a lifting force is applied to hoist bar 30.

In order to open clamp 20 so that it may be attached to, or detached from, barrier modules, it is first necessary to relieve any lifting force on hoist bar 30. Pin 45 may then be pulled forward by operation of lever 52 to thereby free bar 30 to move upwardly relative to latching means 40. A lifting force then applied to bar 30 is transferred by way of crossarm 31 to chains 37. Those chains, in turn, attach to the lower ends of pivot arms 36 at ears 35 and cause arms 36 to pivot outwardly about pivot point 38. Inner ends 61 of arms 36 force latching means 40 downward to the top of plate 22 thereby limiting the outward, pivoting movement of arms 36 and attached jaw members 23. Jaw members 23 of clamp 20 will then be held in an open position, as shown in FIG. 5, so long as a lifting force is applied to hoist bar 30. Thus, it can be seen that the clamp can neither be accidentally opened nor closed at any time a lifting force is applied to the hoist bar.

Figure 6:
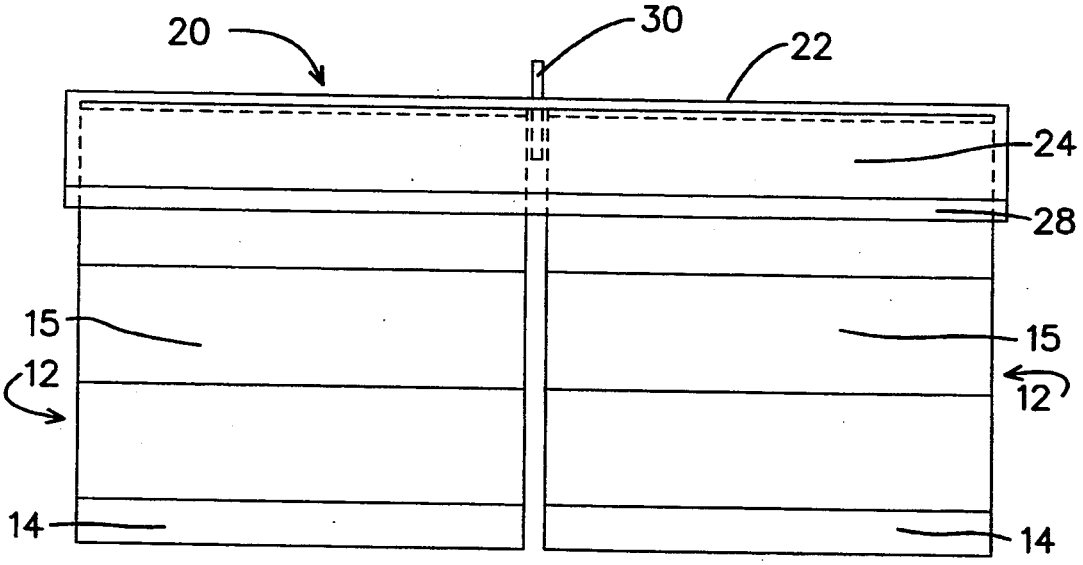
FIG. 6 is a partial side view showing the module lifting device of this invention positioned for use in hoisting a pair of barrier modules.

Referring now to FIG. 6, as well as to the other Figures, there is shown a partial side view of the barrier module clamp of this invention, as it appears in use lifting a pair of modules. The modules 12 are aligned end-to-end and are spaced apart a short distance 64. Clamp 20, with the jaws in open position as is shown in FIG. 5, is lowered over the modules and is centered over the pair by inserting the lower end of hoist bar 30 into the gap 64 between the modules. The bottom side of top plate 22 then comes to rest upon the upper surface of the module T-section 13 allowing jaws 23 to swing inwardly to the position shown in FIG. 4, and positioning the jaw lifting surfaces 27 directly below the underface 18 of the barrier module. As hoist bar 30 is lowered, it arrives at the point where hole 50 in the bar aligns with the holes 49 in the front and rear plates of latching means 40. Pin 45, pushed backwardly by the force of spring 46, then is inserted through the aligned holes to lock the jaws 23 into place for lifting the modules.

As may now be appreciated, the module lifting clamp of this invention provides a much safer and more convenient way of loading, unloading and placing barrier modules than has been previously available to the industry. A particular advantage provided by this invention is the ability to repeatedly handle barrier modules without damage to the critical underface of the upper T-shaped section of the modules. Although the described and preferred embodiment of the lifting clamp is arranged to handle two modules at a time, other embodiments of the clamp may be provided to handle one, or three, modules at a time. It will also be recognized by those skilled in this art that numerous modifications of the devices that have been described can be made without departing from the spirit and scope of the invention.

I claim:

1. A device for lifting and placing concrete barrier modules of the type having a T-shaped upper section, comprising:

a generally rectangular top plate having a width substantially equal to the width of the top of a barrier module;

a pair of jaw members hingeably attached to said plate and hanging downwardly therefrom, one at each side thereof, each of said jaw members having a generally rectangular jaw face with an inwardly turned lifting surface opposite its hinged side, the height of each said jaw face being slightly greater than is the thickness of the T-shaped upper section of said module, and each said lifting surface adapted to contact the underside of said T-shaped upper module section; and means to apply a lifting force to said device through said plate and jaw members, said means including a hoist bar aligned perpendicularly to said plate and arranged to accept said lifting force and to be movable between two positions, the first said position causing a closing force to be exerted on said jaw members at all times that a lifting force is applied to said hoist bar, and the second said position causing an opening force to be exerted on said jaw members at all times that a lifting force is applied to said hoist bar.

2. The device of claim 1 wherein said means to apply a lifting force includes a latching means, said latching means arranged to secure said hoist bar in either said first position or said second position.

3. The device of claim 2 wherein a pivot arm is attached to each said jaw face, said pivot arm having an upper, inner end and a lower, outer end and a pivot point therebetween, said pivot point forming a hinge between said plate and said jaw members.

4. The device of claim 3 wherein said latching means interact with said upper, inner pivot arms when said latching means are arranged to secure the hoist bar in said first position whereby a lifting force applied to said hoist bar is transferred to the inner pivot arm ends.

5. The device of claim 3 including a crossarm attached to said hoist bar, said crossarm extending parallel to said pivot arms to a point beyond the boundary of said plate and disposed perpendicular to the plane of said plate.

6. The device of claim 5 wherein a flexible connecting member extends from each crossarm end to an adjacent lower, outer pivot arm end.

7. The device of claim 6 wherein said hoist bar and latching means are arranged so that a lifting force applied to the hoist bar is transferred to said lower, outer pivot arm ends through said crossarm and flexible connecting members when said latching means are in said second position.

8. The device of claim 2 wherein said hoist bar is arranged to move vertically through an opening in the center of said top plate and wherein the amount of said vertical movement is limited by said latching means.

9. The device of claim 8 wherein said latching means includes a housing having a front plate and a rear plate, said housing and plates defining a passageway for said hoist bar.

10. The device of claim 9 including pin means contained within said housing, said front and rear plates having holes aligned with the axis of said pin, and spring means arranged to urge an end of said pin through said plate holes.

11. The device of claim 10 wherein said hoist bar is arranged with a hole that is alignable with said pin axis, and wherein movement of said pin through the hole in said hoist bar secures said hoist bar in its first position.

12. The device of claim 11 wherein the other end of said pin is connected to a lever that is arranged to remove the pin from the hole in said hoist bar, thereby allowing said hoist bar to move relative to said latching means.

13. The device of claim 1 wherein said top plate and said jaw members are of substantially equal length, and wherein the length of said top plate is substantially twice the length of a barrier module.

14. The device of claim 8 wherein the lower end of said hoist bar extends through said top plate, and is arranged to fit between two barrier modules when said modules are lifted simultaneously.

15. A method for lifting and placing concrete barrier modules, comprising:

providing a T-shaped upper section to said modules, said upper section having a flat, horizontally disposed undersurface;

aligning a pair of modules end-to-end and spacing said modules apart a short distance;

providing a clamp device, said device including a top plate having a width substantially equal to the width of said upper module section, and a length substantially equal to the combined length of said module pair; said device having a pair of jaw members hingeably attached, one to each side of said plate, and hanging downwardly therefrom, each of said jaw members having a generally rectangular jaw face with an inwardly turned lifting surface opposite said hinged side, the height of each jaw face being slightly greater than the thickness of said upper module section, and each lifting surface adapted to press upon said module undersurface; said device further having a hoist bar aligned perpendicularly to the plane of said top plate and arranged to move vertically through an opening in the center of said top plate and through a latching means, said latching means arranged to secure the hoist bar in either a first position wherein a closing force is exerted on said jaw members at all times that a lifting force is applied to said hoist bar, or a second position wherein an opening force is exerted on said jaw members at all times that a lifting force is applied to the hoist bar;

lowering said clamp device with the hoist bar secured in said second position over a pair of modules until said top plate rests on the modules;

causing said latching means to move to the first said position; and hoisting said modules by supplying a lifting force to the hoist bar.

* * * * *